US006467880B2

(12) United States Patent
Rhodes

(10) Patent No.: US 6,467,880 B2
(45) Date of Patent: Oct. 22, 2002

(54) INK JET PRINTER AND DEFLECTOR PLATE THEREFOR

(75) Inventor: Paul Martin Rhodes, Huntingdon (GB)

(73) Assignee: Linx Printing Technologies PLC, Cambridgeshire (GB)

( * ) Notice: Subject to any disclaimer, the term of this patent is extended or adjusted under 35 U.S.C. 154(b) by 0 days.

(21) Appl. No.: 09/755,331

(22) Filed: Jan. 5, 2001

(65) Prior Publication Data

US 2001/0001244 A1 May 17, 2001

Related U.S. Application Data

(62) Division of application No. 09/315,735, filed on May 20, 1999.

(30) Foreign Application Priority Data

May 20, 1998 (GB) ..... 9810857

(51) Int. Cl.[7] ..... B41J 2/04
(52) U.S. Cl. ..... 347/54
(58) Field of Search ..... 347/54, 68, 69, 347/70, 71, 50, 40, 74, 77, 76, 49, 73; 399/261; 361/700; 29/890.1; 310/328–330

(56) References Cited

U.S. PATENT DOCUMENTS

| | | | | |
|---|---|---|---|---|
| 3,761,941 | A | 9/1973 | Robertson | |
| 3,977,010 | A | 8/1976 | Erickson et al. | |
| 4,122,458 | A | 10/1978 | Paranjpe | |
| 4,524,366 | A | 6/1985 | Yamada | |
| 4,620,195 | A | 10/1986 | Eblen et al. | |
| 5,394,180 | A | 2/1995 | Soucemarianadin et al. | |
| 5,396,274 | A | 3/1995 | Ortquist et al. | |
| 5,434,609 | A | 7/1995 | Rhodes | 347/77 |
| 5,455,614 | A | 10/1995 | Rhodes | 347/74 |
| 5,523,778 | A | 6/1996 | Fickling | |
| 6,106,600 | A | 8/2000 | Lecheheb et al. | |

FOREIGN PATENT DOCUMENTS

| | | |
|---|---|---|
| EP | 0 039 772 | 11/1981 |
| EP | 0 108 589 | 5/1984 |
| EP | 0 153 436 | 9/1985 |
| EP | 0 531 156 A2 | 3/1993 |
| EP | 0 671 269 | 9/1995 |
| WO | 93/24329 | 12/1993 |
| WO | WO 94/08792 | 4/1994 |
| WO | WO 98/28147 | 7/1998 |

*Primary Examiner*—Raquel Yvette Gordon
(74) *Attorney, Agent, or Firm*—Cohen, Pontani, Lieberman & Pavane

(57) ABSTRACT

A combined deflection electrode and phase sensor electrode for a deflection type ink jet printer is made up of a ceramic support plate 19, a conductive layer 21 acting as the deflection electrode, layers of insulator 25 covering the conductive layer 21, and a patch of conductive material on the layers of insulator 25 to provide a phase sensor electrode 29 (Alternative constructions are also disclosed). A time of flight sensor electrode 31 may also be provided in the same way. The layers of insulator 25 prevent the sensor electrodes 29, 31 from being electrically connected, by splashes of conductive ink, to the deflection electrode provided by the conductive layer 21. The sensor electrodes 29,31 can have a larger sensing area than separately provided electrodes, allowing them to be further from the ink jet and thereby easing alignment requirements. Additionally, the flight path of the ink jet from the nozzle 1 to the gutter 11 is shortened by placing the sensor electrodes 29, 31 within the length of the deflection electrode. The combined electrode design may be applied to single jet printers, double jet printers and printers having an array of jets (e.g. for printing graphics).

30 Claims, 11 Drawing Sheets

INK JET PRINTER AND DEFLECTOR PLATE THEREFOR

This is a division of application Ser. No. 09/315,735 filed May 20, 1999.

Normally, such deflection type ink jet printers are continuous jet printers, in which the ink jet runs continuously and drops not used for printing are caught by a gutter (and typically re-circulated to the ink supply). Such printers may be arranged either so that undeflected ink drops pass from the ink gun to the gutter, and drops are deflected out of the path leading to the gutter in order to be printed, or so that drops are deflected into the gutter and printing takes place with undeflected drops. In either case, the printer may be constructed to apply different levels of the deflection to different drops, so as to provide a range of printing positions.

One known type of deflection ink jet printer typically has only one ink jet nozzle, and the drops are deflected to a variety of possible printing positions. Such printers are typically used for printing information and indicia such as "sell-by" dates, code numbers, bar codes and logos onto foodstuffs and packages (e.g. yoghurt pots, eggs, milk cartons etc), manufactured articles, packaging and other articles which are conveyed past the print head on a conveyor belt or other conveying mechanism. Devices of this type are described, for example, in U.S. Pat. No. 5,481,288 (and WO-A-89/03768), U.S. Pat. No. 5,126,752 (and EP-A-0424008), U.S. Pat. No. 5,434,609 (and EP-A-0487259) and U.S. patent application Ser. No. 940667 (and EP-A-0531156), all of which are incorporated herein by reference. In another type of deflection ink jet printer, a plurality of ink jet nozzles are arranged in a row, and typically undeflected drops from each nozzle are used for printing while deflected drops are caught by the gutter (either a common gutter for all jets or a plurality of gutters). This type of printer is normally used for printing graphics.

In a normal continuous jet deflection type ink jet printer the ink leaves the nozzle in an unbroken stream of ink and breaks into drops a short distance from the nozzle. The ink jet is modulated, typically by applying a vibration to it in accordance with a modulation drive signal, in order to ensure that it breaks into drops in a controlled manner and at a desired frequency. The length of time between the moments when successive drops break from the ink jet is known as the drop period. Normally the drop period is controlled by, and can be determined from, the frequency of the modulation drive signal. The phase position of the moments when successive drops break from the ink jet will be referred to as the drop separation phase.

An electrically conductive ink is used and the voltage of the ink at the nozzle is held constant. An electrode, known as the charge electrode, is provided adjacent the path of the ink jet at the point where it breaks into drops. A voltage on the charge electrode will induce an electric charge in the part of the ink jet which is close to the electrode, and when a drop separates from the ink jet some of this charge is trapped on the drop. A deflection electrode arrangement creates an electric field which acts on the charge trapped on the drop to deflect it from the direction in which the ink jet is travelling when it leaves the nozzle.

In normal practice, different levels of deflection are applied to different drops by providing different voltages to the charge electrode for different drops, and thereby capturing different quantities of charge on different drops. As. an alternative, it has been proposed (e.g. in U.S. Pat. No. 4,122,458) to provide different strengths of the electric field for different drops. Whatever aspect of the system is changed to apply different levels of deflection to different drops, the changes must be made with a correct phase relative to the drop separation phase so as to ensure that each drop is deflected correctly. Therefore it is necessary to conduct an operation, known as phasing, to discover the drop separation phase.

During phasing a special signal is applied to the charge electrode. The frequency of this special signal corresponds to the drop period and its waveform is chosen so that the quantity of charge trapped on the ink drops depends on the phase position of the special signal relative to the drop separation phase. Normally the special signal is applied at several different phase angles during a phasing operation. By monitoring the level of charge trapped on the ink drops during phasing it is possible to identify the drop separation phase. The details of the phasing operation can vary greatly. U.S. Pat. No. 5,481,288 (and WO-A-89/03768) shows one approach. U.S. Pat. No. 3,761,941 shows a different approach.

The phasing operation depends on being able to detect the level of charge captured on the ink drops. One way of doing this is to provide an electrode, known as a phase sensor electrode, downstream of the charge electrode. The phase sensor electrode is very close to the path of the drops and a brief current signal is induced in it by each charged drop as it passes. It is optionally possible also to provide another electrode (known as a time of flight sensor electrode) further along the path of the ink drops, spaced by a known distance from the phase sensor electrode, which is also placed very close to the ink path and has a current signal induced in it by charged drops passing it. By measuring the time between signals induced on these two electrodes, it is possible to measure the ink jet velocity.

FIGS. 1 and 2 show plan and side views, respectively, of the main components of an example of an ink jet printer head using a phase sensor electrode and a time of flight sensor electrode. In FIGS. 1 and 2, the ink jet is emitted as a continuous stream from the nozzle 1 of an ink gun, and passes through a slot in a charge electrode 3. The continuous ink stream from the nozzle 1 breaks up into drops while it is in the slot in the charge electrode 3. The ink is electrically conductive and the ink gun is held at a fixed potential (usually zero volts for convenience and safety). The voltage on the charge electrode 3 induces a charge in the portion of the ink jet within the slot of the charge electrode, and as ink drops separate from the ink stream, the charge is captured in the drops. The amount of charge captured in each drop is controlled by varying the voltage applied to the charge electrode 3 (e.g. in the range 0 to 255 V). In this way, the charging signal applied to the charge electrode 3 controls the extent of the subsequent deflection of the ink drops.

The drops of ink then pass over the phase sensor electrode 5, which is used to detect the level of charge of the drops during a phasing operation as described above. The drops then pass between two deflection electrodes 7, 9, which are maintained at substantially different potentials (typically with a difference of 6 to 10 kV between them), so as to provide a strong electric field. This field deflects the charged ink drops, and the extent of deflection depends on the amount of charge on each drop. Drops with zero charge, or only a minimal charge, will pass through the field experiencing no deflection, or only minimal deflection, and will be caught by a gutter 11. Drops with higher levels of charge will be deflected sufficiently to miss the gutter 11 and will therefore continue in flight until they reach the surface 13 to be printed onto, and form a dot thereon. The range of possible deflection paths for dots to be printed ranges from the minimum degree of deflection necessary to miss the gutter 11 to the maximum amount of deflection possible before the deflected dot strikes the deflection electrode 7. The maximum and minimum deflected paths for printing are illustrated in FIG. 1.

Drops of ink having a minimal level of charge, so that the angle of deflection is not sufficient for the drop to escape the gutter 11, will pass over a time of flight sensor electrode 15 located between the deflection electrodes 7, 9 and the gutter 11. The time of flight sensor electrode 15 will respond to the charge on the drops to provide a signal which, together with the signal from the phase sensor electrode 5, can be used to measure the velocity of the ink drops as discussed above.

The phasing operation and time of flight measurement are carried out using a very low level of charge on the ink drops (normally of the opposite sign to the charge used for printing) so that the drops are still caught by the gutter 11. This limits the level of the signal which can be obtained from the phase sensor electrode 5 and the time of flight sensor electrode 15. In order to avoid these relatively small signals from being swamped by noise, the electrodes are configured as sensor electrode pins surrounded by and insulated from earthed shielding cylinders.

The arrangement illustrated in FIGS. 1 and 2 operates satisfactorily in practice but it has some drawbacks.

First, as is evident in FIGS. 1 and 2, both the phase sensor electrode 5 and the time of flight sensor electrode 15 occupy space in the line from the nozzle 1 to the gutter 11, and consequently the presence of these electrodes increases the path length of the ink drops from the nozzle 1 to the gutter 11. It is inherently desirable to minimise this distance, because the shorter the ink path length the less effect instabilities in the ink issuing from the nozzle have on the eventual position of ink drops, and also because the shorter this distance is the greater the clearance which can be provided between the end of the printhead and the surface 13 being printed onto for any given size of printed characters. It is not easy to reposition the sensor electrodes 5, 15 to reduce the path length, since the sensors must be positioned downstream of the charge electrode in order to detect charged ink drops and must be upstream of the gutter 11, and they must also be at a safe distance from the deflection electrodes 7, 9 in order to avoid arcing between the high voltages applied to the deflection electrodes 7, 9 and the sensors or their earthed shields.

Second, in order to detect the low level of charge on the drops used for phasing and time of flight measurement, the ink drops must pass very close (typically 0.35 mm to 0.45 mm) to the top of the phase sensor electrode 5 and the time of flight sensor electrode 15. This adds a further constraint to the alignment requirements when manufacturing the printhead, in addition to the requirement for the jet to be aligned correctly through the slot in the charge electrode 3 and with the gutter 11.

Third, the phase sensor electrode 5 tends to accumulate a layer of caked dried ink, mostly from splashes of misdirected ink during start-up of the ink jet. Because the ink path passes very close to this sensor, only a small amount of caked dried ink can be tolerated on the sensor before it begins to interfere with ink drops passing along the correct path, and therefore the phase sensor electrode 5 must be cleaned frequently.

Fourth, if a splash of conductive ink hits the top of the phase sensor electrode 5 or the time of flight sensor electrode 15, the conductive nature of the ink tends to short the sensor electrode to the earth shield, preventing the sensor electrode from detecting any signal until the ink has dried and ceased to be conductive. This problem can be overcome by fitting an insulating cover over the top of the sensor electrodes 5, 15, but this increases manufacturing cost and also reduces the clearance between the electrode assembly and the ink jet.

In one aspect, the present invention provides a phase sensor electrode (and optionally also a time of flight sensor electrode) mounted on or combined with a deflection electrode. At least some embodiments avoid or reduce at least some of the drawbacks discussed above, but it is not an essential feature of the present invention to reduce all of them.

In one embodiment, the present invention provides a deflector plate for an ink jet printer comprising an electrically conductive deflection electrode, a layer of insulation on the side of the deflection electrode which would be towards the ink jet in use, and a sensor electrode or aerial overlying a part of the deflection electrode but separated from it by the insulating layer. In principle, it is possible to make this plate by using a self-supporting metal sheet as the deflection electrode, but is it preferred instead to use an insulating substrate to support the plate, for example made of a ceramic material, and then to lay down the deflection electrode, the insulating layer and the sensor electrode in turn on the substrate. This can be done, for example, by screen printing and baking according to known techniques for making hybrid circuit boards. In another aspect, the present invention includes a method of making an electrode plate for an ink jet printer comprising forming a deflection electrode, forming an insulating layer on it, and forming a sensor electrode on the insulating layer.

In another aspect, the present invention provides an ink jet printer having a deflection electrode and a sensor electrode or aerial in which the sensor electrode or aerial is formed on the deflection electrode but separated therefrom by an insulating layer.

In use, the deflection electrode is preferably maintained at substantially the same voltage as the sensor electrode, which will normally be the ground voltage of the sensing electronics to which the sensor electrode is connected. In this way, the sensor electrode does not substantially affect the deflection field caused by the deflection electrode. The potential applied to the other deflection electrode is then chosen to ensure that the desired deflection field is created. The deflection electrode on which the sensor electrode is mounted, and possibly the other deflection electrode also to some extent, shields the sensor electrode to minimise the amount of noise which the sensor electrode picks up.

Preferably, this arrangement is used to provide the phase sensor electrode. As discussed above, the presence of the time of flight sensor electrode is optional. If the time of flight electrode is required, then preferably it is also formed on a deflection electrode in this manner.

As will be appreciated from the discussion of the illustrated embodiments, at least some embodiments of the present invention allow the sensor electrode to be provided within the length of the deflection electrodes, so that no separate length of ink path is required to accommodate the sensor electrode. The sensor electrode as formed on the deflection electrode can be substantially larger than would normally be the case for the separate sensor electrodes of the type illustrated in FIGS. 1 and 2, and therefore the sensor electrode is more sensitive to the charged ink drops. Consequently, it can be mounted further away from the ink path, requiring less precise alignment of the ink jet and also permitting a greater build up of dried ink on the electrode before the accumulated dried ink interferes with the ink path. Preferably, the insulating layer extends beyond the edge of the sensor electrode to a substantial extent, and more preferably the entire surface of the deflection electrode on which the sensor electrode is mounted is covered by the insulating layer. Consequently, splashes of ink striking the sensor electrode or the deflection electrode tend not to bridge the insulating layer and short circuit the sensor electrode to the deflection electrode. It is also preferable that there is no insulation covering the sensor electrode, so that splashes of ink touching the sensor electrode are electrically connected to it. In this way, while the splashes are wet and still conductive, they act as extensions of the sensor electrode rather than acting as electrically separate covering layers which would tend to shield the sensor electrode and reduce its sensitivity.

Embodiments of the present invention, given by way of non-limiting example, will now be described. In order to provide illustrative embodiments, many optional features will be described in combination, even though they are logically separable, as will be apparent to those skilled in the art, and it is not a requirement of the present invention that such optional features are present only in the combinations described by way of example.

Figure 22:
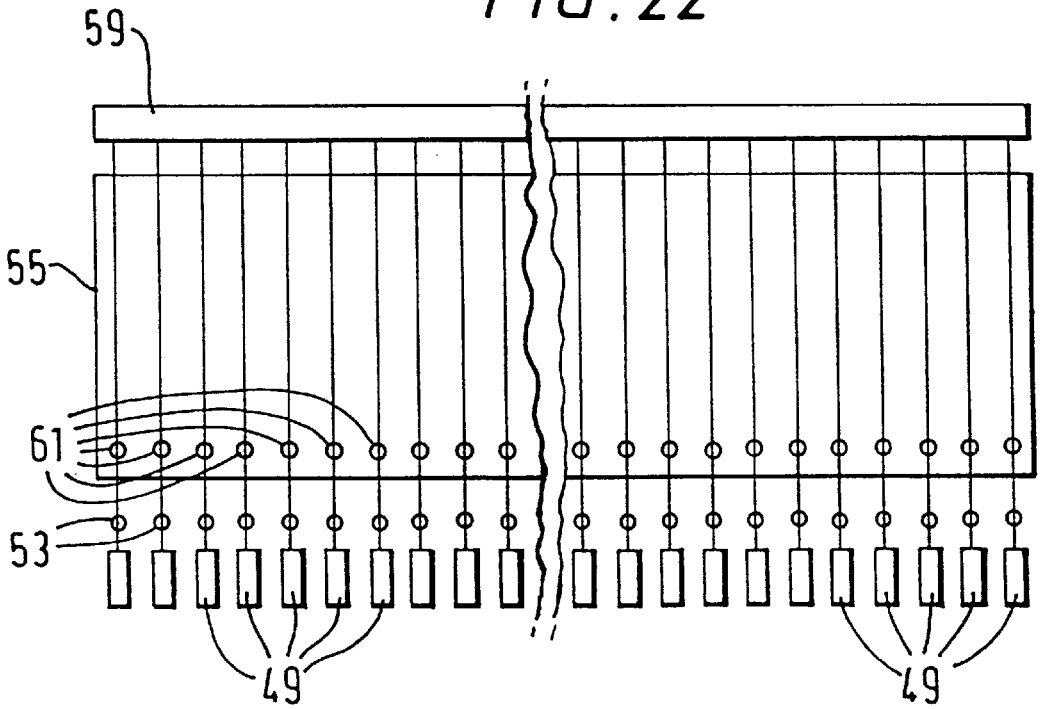
FIG. 22 is a view at 90° from the direction of view of FIG. 21, showing the ink jets and one of the deflection electrodes.

FIGS. 23 to 28 each show alternative designs for the face towards the ink jets of the deflection electrode shown in FIG. 22.

Figure 29:
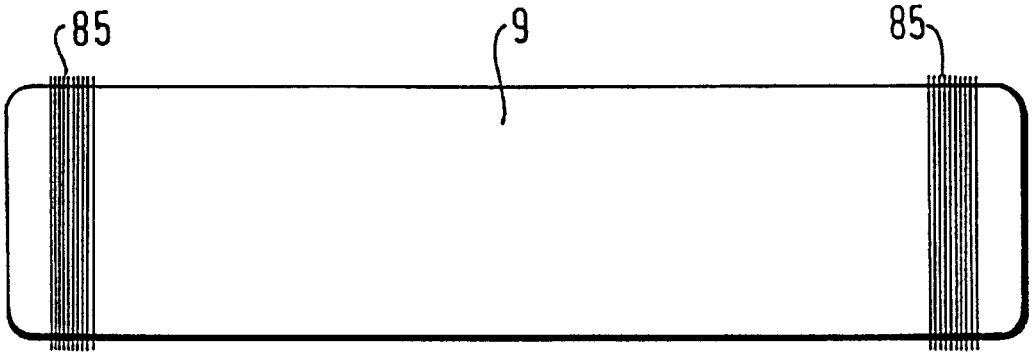

FIG. 29 shows an alternative construction for the electrode assembly.

Figure 30:
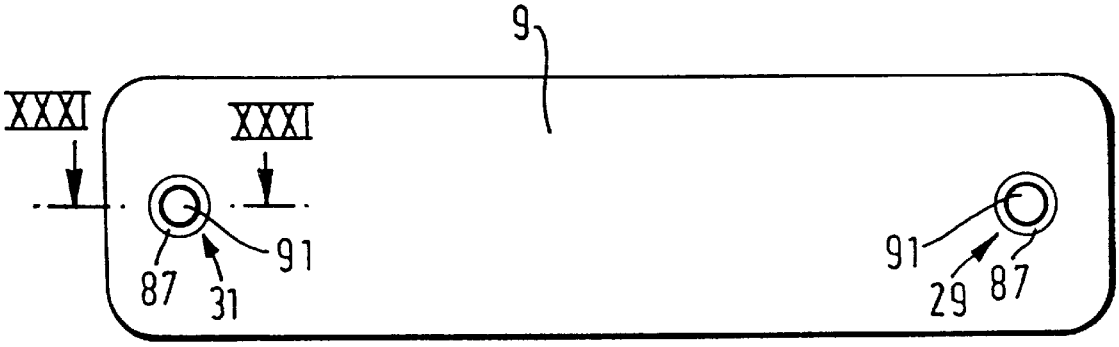

FIG. 30 shows another alternative construction for the electrode assembly.

Figure 31:
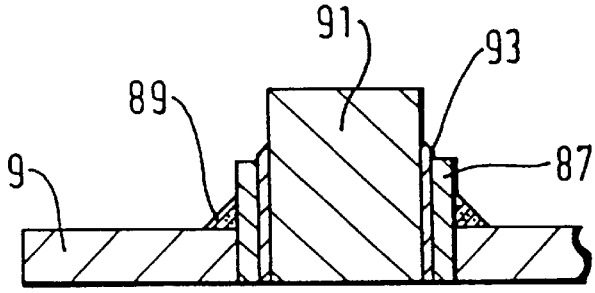

FIG. 31 is a partial section of the electrode assembly of FIG. 30 in the region of a sensor electrode.

Figure 3:
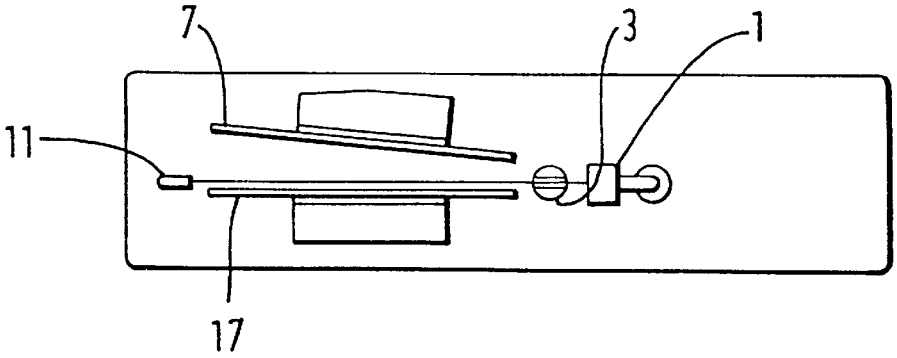
FIG. 3 is a view, corresponding to FIG. 1, of an embodiment of the present invention.
Figure 4:
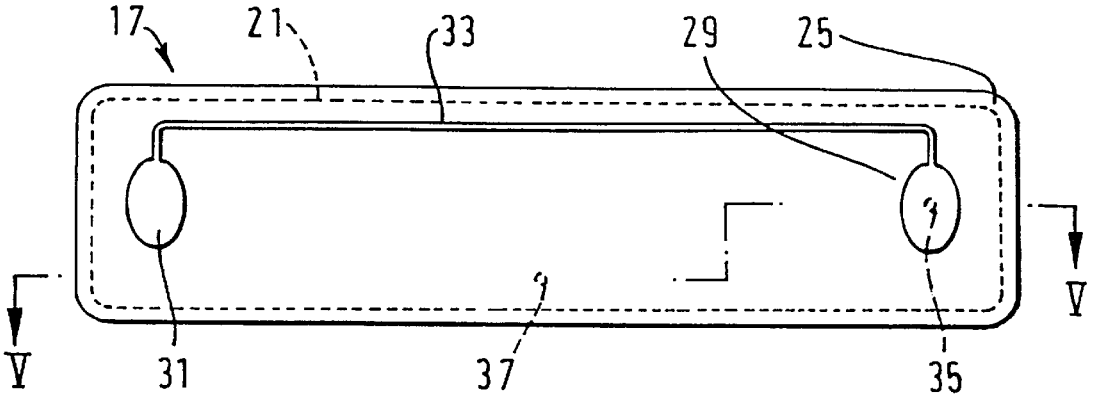
FIG. 4 shows the face towards the ink jet of an electrode assembly in the embodiment of FIG. 3.
Figure 5:
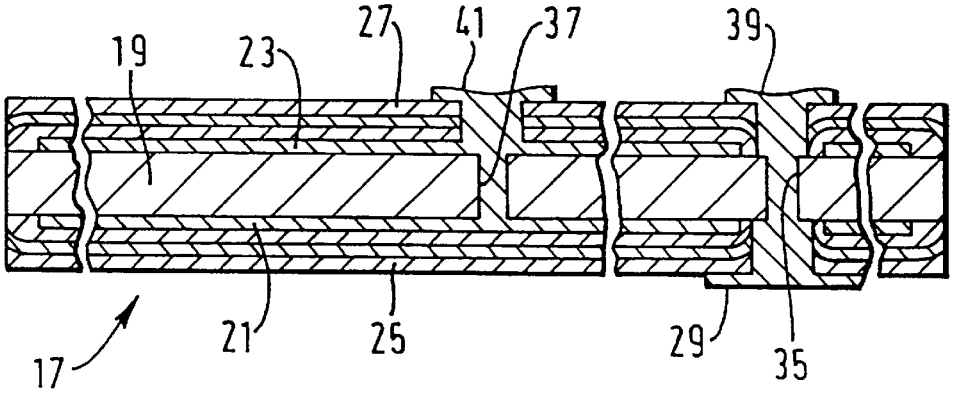
FIG. 5 is a section through the electrode assembly of FIG. 4.

FIG. 3 is a plan view of an ink jet printer head embodying the present invention. FIG. 4 is a view of the side, facing the ink jet, of an electrode assembly in the print head of FIG. 3. The electrode assembly replaces the deflection electrode 9 which is parallel to the path of undeflected drops in FIG. 1. FIG. 5 is a section through the electrode assembly of FIG. 4.

Figure 1:
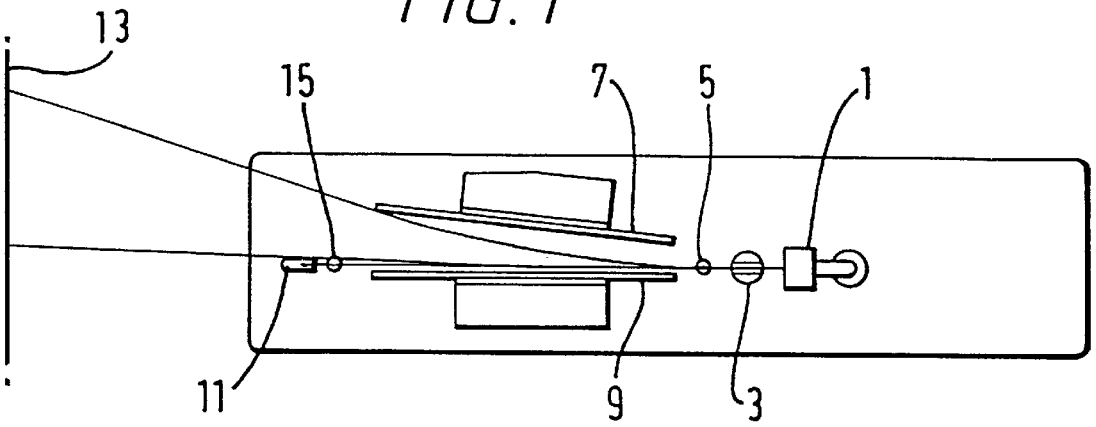
FIG. 1 is a plan view of the main components of a prior art ink jet printer head.

In this embodiment the phase sensor electrode 5 and the time of flight sensor electrode 15 of FIG. 1 are replaced by the electrode assembly 17 which also replaces one of the deflection electrodes 9. This enables the flight path of undeflected drops from the nozzle 1 to the gutter 11 to be shortened, as can be seen by comparing FIG. 3 with FIG. 1.

As shown in FIGS. 4 and 5, the electrode assembly 17 comprises a ceramic plate 19 on which the other parts of the assembly are formed by screen printing and baking according to known techniques for forming hybrid printed circuit boards. On each side of the ceramic plate 19 a conductive layer 21, 23 is provided. These conductive layers extend over almost all of the respective face of the ceramic plate 19, but stop slightly short of the edge of the ceramic plate 19, as can been seen in FIG. 5 and as is also shown by a broken line in FIG. 4. Each of the conductive layers 21, 23 is covered by a triple layer of insulator 25, 27 according to standard hybrid circuit board manufacturing practice. The precise number of layers of insulator can be varied but it is preferred to use a plurality of layers to avoid possible pinhole defects and other gaps in the insulator. The layers of insulator 25, 27 extend up to the edge of the ceramic plate 19, so as to cover the respective conductive layer 21, 23 entirely. In this way, the conductive layer 21 on the side of the ceramic plate 19 toward the ink jet is sealed against contact by splashes of ink.

A phase sensor electrode 29 and a time of flight sensor electrode 31 are formed by patches of conductive material provided on top of the triple layer of insulator 25 on the side of the electrode assembly 17 towards the ink jet. These act as aerials and respond to the electrical charge on ink drops as they pass, and this is used in the phasing operation and for measurement of time of flight as discussed above.

As shown in FIG. 4, the sensor electrodes 29, 31 have the shape of ellipses, with the short axis extending parallel to the flight path of the ink drops and the long axis extending across the width of the electrode assembly 17. They are each positioned approximately midway across the width of the electrode assembly 17, and the electrode assembly 17 is mounted on the printhead so that the ink jet is substantially level with the widest part of each of the sensor electrodes 29, 31. In this way, there is a strong coupling between the charged ink drops and each sensor electrode 29, 31 so as to provide a satisfactory signal amplitude from the sensors during the phasing and time of flight measurement operations.

The phase sensor electrode 29 and the time of flight sensor electrode 31 are connected together so that their output signals are provided on a common signal line. This connection is provided by a thin conductor line 33 formed on the triple layer of insulator 25. In order to reduce the amplitude of signals induced in the conductor line 33 by charged ink drops, the line is positioned near one edge of the electrode assembly 17 rather than midway across its width.

Additionally the conductor line 33 is made thin both to reduce the signal induced in it by ink drops and to reduce the amount of noise which it picks up. In this way, the output provided on the common signal line consists substantially only of pulses provided by the two sensor electrode 29, 31.

The conductive layer 21 on the side of the ceramic plate 19 towards the ink jet acts as one of the deflection electrodes. This is held at a fixed voltage which is substantially the same as the voltage of the sensor electrodes 29, 31. The deflection field is formed between this conductive layer 21 and the other deflection electrode 7, to which an appropriate high tension voltage is applied to generate the desired field. Because the sensor electrodes 29, 31 are at substantially the same potential as the conductive layer 21 and are not substantially out of the plane of the conductive layer 21, they do not significantly distort the deflection field. However, the sensor electrodes 29, 31 are insulated from the conductive layer 21 by the layers of insulator 25, even in the case of ink splashes, since otherwise the fixed potential of the conductive layer 21 would prevent any signal from being output by the sensor electrode 29, 31. The conductive layer 21 is also connected to the other conductive layer 23, on the other side of the ceramic plate 19, and both conductive layers provide electrical shielding to minimise the effect on the sensor electrodes 29, 31 of electrical noise originating on the other side of the electrode assembly 17 from the ink jet.

As shown in FIG. 5, two connection holes 35, 37 are formed in the ceramic plate 19. One connection hole 35 is formed behind the phase sensor electrode 29 and connects it (and the conductor line 33 and the time of flight sensor electrode 31) to a sensor electrode connection pad 39 on the other side of the electrode assembly 17. The conductive layers 21, 23 and layers of insulator 25, 27 all have holes around (preferably concentric with) the connection hole 35, and the holes in the conductive layers 21, 23 are larger than the holes in the layers of insulator 25, 27 so that the conductive layers 21, 23 are fully insulated from the sensor electrode connection pad 39 and the conductive material filling the connection hole 35. The other connection hole 37 is used to connect together the two conductive layers 21, 23, and these are also connected through a hole in the layers of insulator 27 to a connection pad 41 for the conductive layers.

During manufacture, the connection holes 35, 37 are filled with conductive material and all of the layers are formed by screen printing and baking according to conventional hybrid circuit board manufacturing techniques. The ceramic plate is preferably a high alumina (e.g. 96%) ceramic. The conductive layers and the layers of insulator are formed by using conductive or insulating printing materials respectively, according to conventional hybrid circuit board technology. Suitable materials are supplied, for example, by Dupont Electronics, Coldharbour Lane, Frenchay, Bristol BS16 1QD, Great Britain. The layers, once formed, should be resistant to methyl ethyl ketone, since this solvent material is commonly used in ink jet printer inks.

As examples of dimensions, the electrode assembly 17 may be 9 or 10 mm wide and 30 to 40 mm long (the length depending on the desired size of printhead which in turn depends on the desired print characteristics). The edges of the conductive layers 21, 23 are about 0.5 mm from the edges of the ceramic plate 19, and about 0.7 mm from the edge of the connection hole 35. The layers of insulator 25, 27 extend up to the edges of the ceramic plate 19, and stop short of the edge of the connection hole 35 by about 0.5 mm. The hole through the layers of insulator 27 for the connection pad 41 is about 1 mm in diameter. The sensor electrode connection pad 39 is not shielded by the conductive layers 21, 23, and so it may tend to pick up noise. For this reason it should be as small as possible, while still being large enough to allow easy connection of a wire, e.g. by soldering. It may be about 2 mm across. The size of the other connection pad 41 is less critical. The connection holes 35, 37 are 0.2 mm in diameter. The conductor line 33 is about 0.3 mm wide, which is as narrow as can reliably be printed with normal silk screen printing techniques. In order to reduce the resistance of the conductor line 33, it may be printed as a double layer of conductive material. The screen printed layers are each about 0.02 mm thick. The ceramic plate 19 is 1 mm thick. The minor axes of the sensor electrodes 29, 31 are about 2 mm and the major axes may be about 3 mm or up to about 6 mm, e.g. about 4 mm or about 5 mm. Instead of being ellipses, the sensor electrode 29, 31 may be provided for example as rectangles the sides of which have dimensions according to the dimensions given for the axes of the ellipses.

Figure 2:
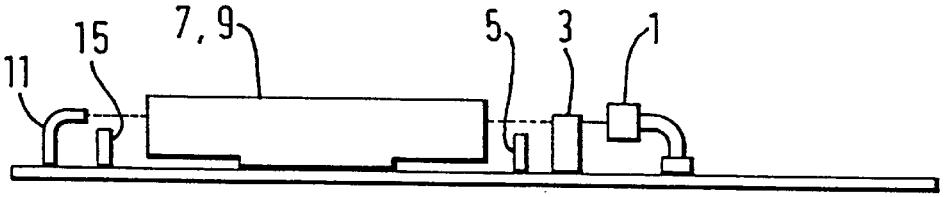
FIG. 2 is a side view of the ink jet printer head of FIG. 1.

The area of each sensor electrode 29, 31 (roughly in the range of 5 to 10 $mm^2$ depending on the design) is much larger than the detecting area (e.g. about 0.8 $mm^2$) of the ends of the sensor electrodes 5, 15 in the design of FIGS. 1 and 2, allowing satisfactory signal amplitude to be obtained at a greater spacing from the ink jet. Accordingly, the electrode assembly 17 of FIGS. 4 and 5 can be mounted for example at about 0.5 to 1.5 mm, preferably 0.9 to 1.2 mm, from the ink jet as compared with the clearance between the ink jet and the sensor electrodes 5, 15 in a printhead according to FIGS. 1 and 2 of about 0.35 to 0.45 mm.

The extent of each of the sensor electrodes 29, 31 in the direction of the flight path of the ink drops is relatively short in order to obtain a sharp pulse response from each sensor electrode in response to charged ink drops. The extent in the direction across the width of the electrode assembly 17 is chosen both to control the overall area (and hence sensitivity) of the sensor electrodes 29, 31 and also according to the desired tolerance for the alignment of the electrode assembly 17 relative to the ink jet. As the extent of each sensor electrode 29, 31 in the width direction of the electrode assembly 17 is increased, its sensitivity to charged ink drops increases but its sensitivity to noise signals also increases. Since parts of the sensor electrodes 29, 31 spaced substantially from the path of the ink drop are relatively insensitive to charged ink drops but are just as sensitive to noise as other parts, it is not desirable to increase the extent of the sensor electrodes 29, 31 in this direction more than is necessary to obtain a sufficient signal amplitude in response to charged ink drops. However, a greater extent of each sensor electrode 29, 31 in this direction allows for greater tolerance in the positioning of the electrode assembly 17 in this direction while still ensuring that the sensor electrodes 29, 31 are at the same level as the ink jet. Therefore the precise design will depend on the manufacturing tolerances and other features of the printhead in any particular case.

The other deflection electrode 7 may also be provided by a conductive layer formed on a ceramic substrate, but is preferably a self-supporting stainless steel plate.

Figure 6:
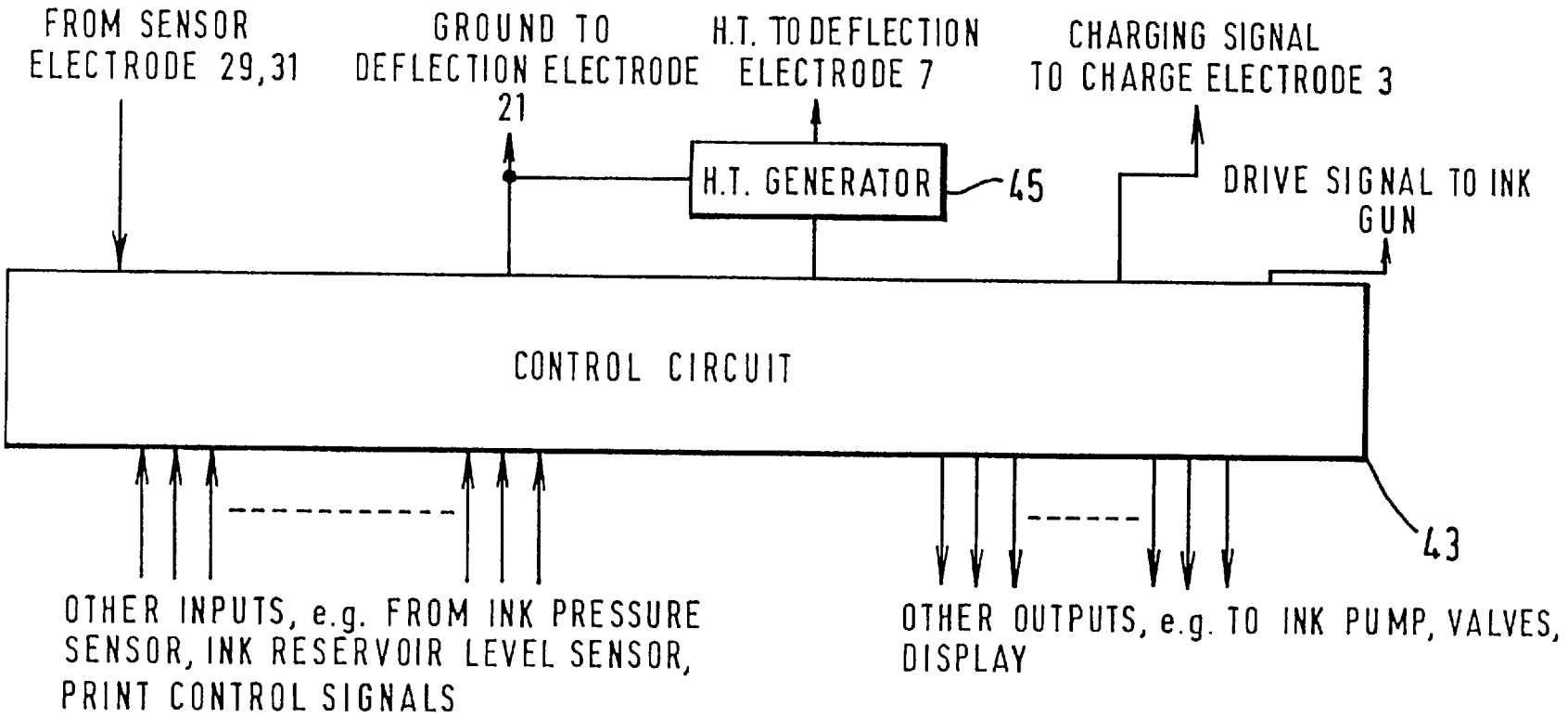
FIG. 6 shows connections to control electronics for the embodiment of FIGS. 3 to 5.

As shown in FIG. 6, the signal from the sensor electrodes 29, 31 is provided to a control circuit 43, which also outputs the charging signal to the charge electrode 3 and the drive signal to the ink gun as discussed above. The control circuit 43 also controls an HT generator 45 for generating the high tension deflection voltage for the deflection electrode 7. The deflection electrode formed by the conductive layer 21 is connected to the ground line of the control circuit 43 and HT generator 45, with the consequence that it at substantially the same voltage as the sensor electrodes 29, 31 as discussed above. The control circuit 43 also receives inputs and provides outputs to other parts of the ink jet printer for controlling other aspects of the printer such as ink supply and controlling the printing operation in the normal manner.

In order to minimise the amount of noise in the signals from the sensor electrodes 29, 31, the control circuit 43 is connected to the sensor electrode connection pad 39 by the core conductor of a coaxial cable and the shield conductor of the coaxial cable is grounded. For convenience, the ground connection to the conductive layers 21, 23 is provided by connecting the shield conductor of the coaxial cable to the connection pad 41 for the conductive layers and connecting it to a ground connection at the control circuit 43.

In principle, it is possible to provide the fixed voltage to the conductive layers 21, 23 from the HT generator 45, so that these are not at the ground potential of the control circuit 43. In this case, the sensor electrodes 29, 31 are enabled to float at the same potential as the conductive layers 21, 23 by providing a DC level shifting capacitor in the connection line between the sensor electrode connection pad 39 and the control circuit 43. However, HT generator circuits tend also to generate electrical noise, and the output HT voltages can have for example a 10 volt ripple superimposed. Because of the very close coupling between the conductive layer 21 and the sensor electrodes 29, 31, any electrical noise or ripple in the voltage applied to the conductive layer 21 is picked up strongly by the sensor electrodes 29, 31, and this can swamp the signals induced by charged ink drops. For this reason, it is preferred to ground the conductive layer 21 as illustrated in FIG. 6.

Figure 7:
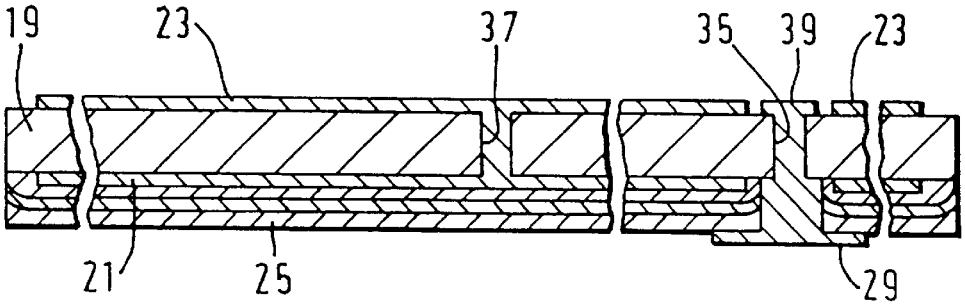
FIG. 7 is a sectional view corresponding to FIG. 5 for an alternative construction of the electrode assembly.

FIG. 7 shows a section through the electrode assembly 17 as an alternative, which may be simpler and cheaper, to FIG. 5. In FIG. 7, no layers of insulator 27 are provided on the side of the ceramic plate 19 remote from the ink jet. The conductive layer 23 on this side is left exposed. The main purpose of the layers of insulator is to ensure that splashes of ink do not contact the conductive layers 21, 23. It is less important to provide the layers of insulator 27 on the side away from the ink jet as splashes of ink are very unlikely to reach this side of the electrode assembly 17. As a consequence, the sensor electrode connection pad 39 is formed directly on the ceramic plate 19, and the connection pad 41 for the conductive layers is omitted. The electrical connection to the conductive layers 21, 23 can be formed by connecting to any convenient point on the conductive layer 23.

Figure 8:
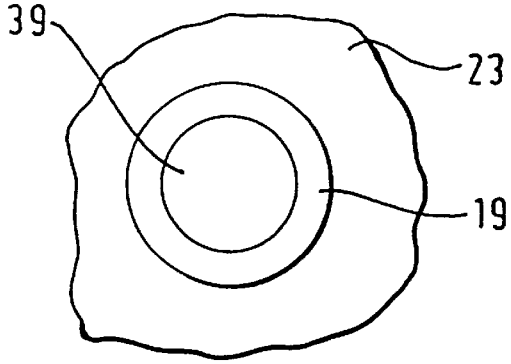
FIG. 8 is a partial view of the face of the electrode assembly away from the ink jet, in the construction of FIG. 7.

FIG. 8 is a partial view of the face remote from the ink jet of the electrode assembly 17 of FIG. 7, in the vicinity of the sensor electrode connection pad 39. Since the layers of insulator 27 are not present, a hole is provided in the conductive layer 23 so that it is spaced from the sensor electrode connection pad 39. The conductive layer 23 and the sensor electrode connection pad 39 can be designed on the same artwork layer, and printed in the same screen printing operation, since they do not overlap, there are no intervening layers, and they may be made of the same material. This reduces the manufacturing cost as compared with the structure of FIG. 5.

Figure 9:
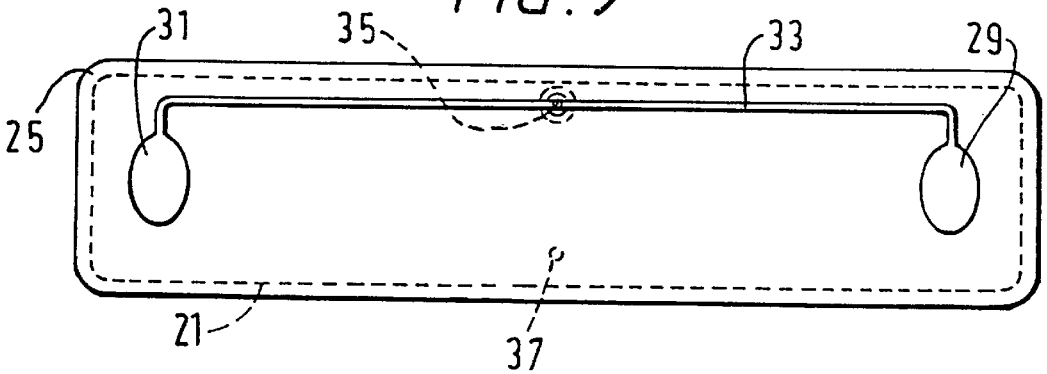
FIG. 9 is a view of an alternative design for the face of the electrode assembly towards the ink jet.
Figure 10:
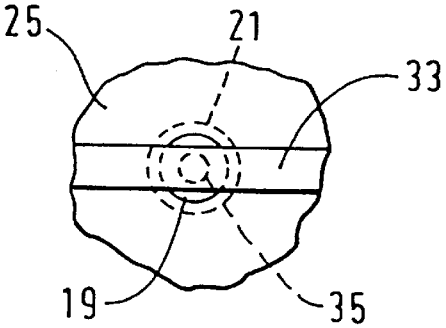
FIG. 10 is an enlarged view of part of FIG. 9.
Figure 11:
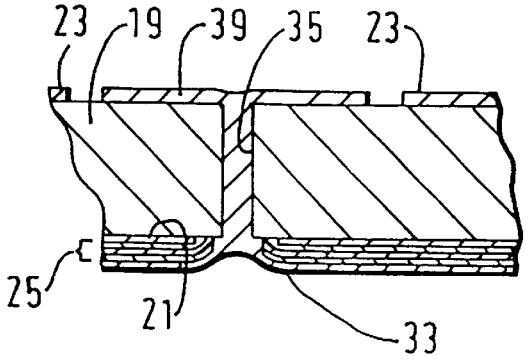
FIG. 11 is a partial section through the electrode assembly of FIG. 9 in the region shown in FIG. 10.

FIG. 9 shows another design for the face of the electrode assembly 17 towards the ink jet, as an alternative to FIG. 4. In this arrangement, the connection hole 35 is formed at the position of the conductor line 33 instead of being formed at the phase sensor electrode 29. FIG. 10 is an enlarged view of the part of FIG. 9 around the connection hole 35. FIG. 11 is a partial view of a section through the electrode assembly 17 in the region of the connection hole 35. The various layers and spaces have dimensions as discussed above. The hole in the layers of insulator 25 is wider than the conductor line 33, so that the edge of the hole is visible in FIGS. 9 and 10. The edge of the hole in the conductive layer 21 is shown in broken lines in FIGS. 9 and 10. The connection hole 35 and the sensor electrode connection pad 39 are preferably mid-way along the conductor line 33, so that any spurious signal induced as the charged drops pass the sensor electrode connection pad 39 is well separated from the signals from the sensor electrodes 29, 31.

Figure 12:
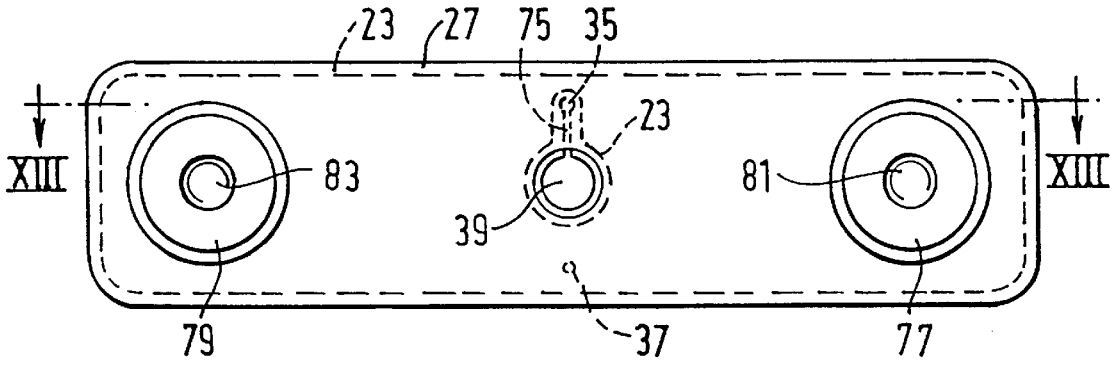
FIG. 12 is a view of the face away from the ink jet of a further construction for the electrode assembly.
Figure 13:
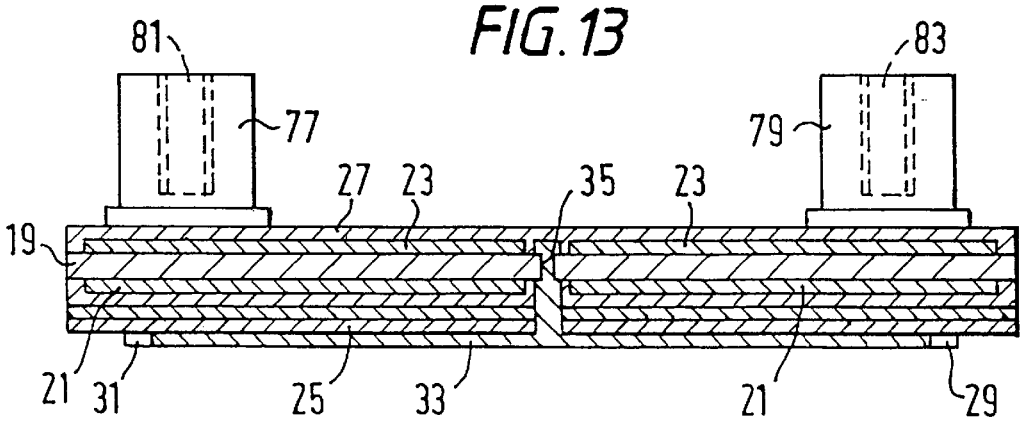
FIG. 13 is a section along the line XIII—XIII of FIG. 12.

In a further alternative design for the electrode assembly 17, the face of the assembly towards the ink jet is as shown in FIG. 9, the other face is as shown in FIG. 12, and a section on the line XIII—XIII is as shown in FIG. 13. In this embodiment, the sensor electrode connection pad 39 is formed in the middle of the face away from the ink jet, and is connected to the connection hole 35 by a short conductor line 75. The conductive layer 23 has a hole extending around the connection hole 35, the conductor line 75 and the sensor electrode connection pad 39, as shown in broken lines in FIG. 12, to avoid any electrical contact.

In this design, a single layer of insulator 27 is provided on the side of the electrode assembly 17 away from the ink jet, and this covers the connection hole 35 and the conductor line 75, and has a hole in it around the sensor electrode connection pad 39. Only a single layer of insulator 27 is used as its function is mainly to protect the conductive layers rather than provide electrical insulation between them.

In this design two cylindrical bosses 77, 79 are soldered to the face of the electrode assembly 17 away from the ink jet, and each boss has a threaded hole 81, 83 formed in it. These holes 81, 83 can be used for bolting the electrode assembly 17 to a fitting provided on the printhead, and therefore provide a convenient way of mounting the electrode assembly 17.

In order to provide a connection pad on the electrode assembly 17 suitable for each boss 77, 79 to be soldered to it, patches of an additional conductive layer may be formed on the layer of insulator 27. However, it is preferred that in the case of at least one of the bosses 77, 79, the connection pad is formed instead by forming a hole in the layer of insulator 27 so as to reveal a disk of the conductive layer 23 to which the respective boss 77 or 79 may be soldered. The bosses 77, 79 are conveniently made of copper or a tin plated metal and therefore are electrically conductive. By soldering one of the bosses directly to the conductive layer 23, the boss provides an electrical connection to which the shield conductor of the coaxial cable for the sensor electrodes may be connected, in order to provide the electrical connection to the conductive layers 21, 23.

Figure 14:
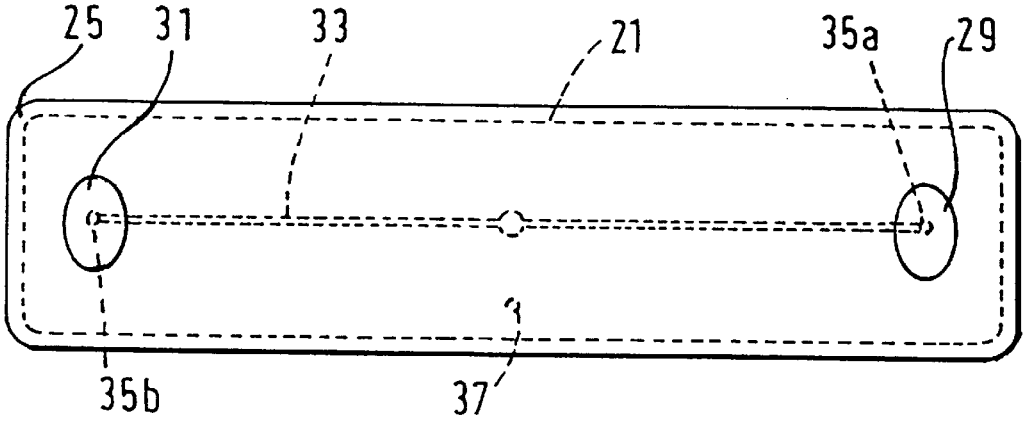
FIG. 14 shows a further alternative design for the face of the electrode assembly towards the ink jet.
Figure 15:
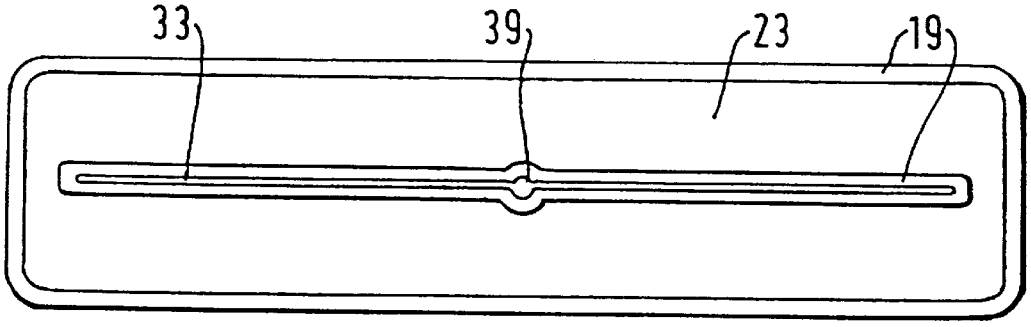
FIG. 15 shows the face of the electrode assembly away from the ink jet for the design of FIG. 14.

FIG. 14 shows another alternative design for the face of the electrode assembly 17 towards the ink jet. In this design, the conductor line 33 is formed directly on the ceramic plate 19 on the side away from the ink jet, and it is connected to the phase sensor electrode 29 and the time of flight sensor electrode 31 by respective connection holes 35*a*, 35*b* at each respective sensor electrode 29, 31. FIG. 15 shows the face of the electrode assembly 17 away from the ink jet in this design. In order to avoid connection between the conductor line 33 and the conductive layer 23, an elongate hole is provided in the conductive layer 23 extending around the conductor line 33. In this design, the conductor line 33 is better shielded from the charged ink drops, thereby reducing this source of noise in the signal from the sensor electrodes 29, 31 to the control circuit 43. However, the conductor line 33 is no longer shielded from other noise arising from the side of the electrode assembly 17 away from the ink jet, and therefore the level of this noise in the signal provided to the control circuit 43 is increased. This arrangement will be desirable or undesirable depending on the comparative amplitudes of the noise from the respective sources.

Figure 16:
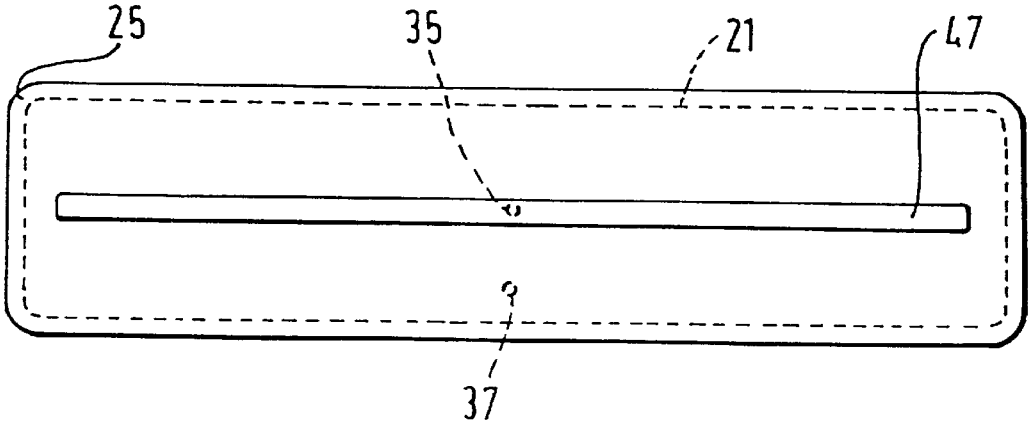
FIG. 16 shows yet a further design of the face of the electrode assembly towards the ink jet.

FIG. 16 is a view of the face of the electrode assembly 17 towards the ink jet in yet a further alternative design. The design of FIG. 16 is substantially different from the design of FIGS. 4, 9 and 14, because the phase sensor electrode 29 and time of flight sensor electrode 31 are not provided in FIG. 16 and instead a single strip shaped sensor electrode 47 is provided extending along most of the length of the electrode assembly 17.

In the designs of FIGS. 4, 9 and 14, a charged ink drop will provide a signal pulse as it passes the phase sensor electrode 29, and will provide another signal pulse as it passes the time of flight sensor electrode 31, while providing only a very small signal, if any, while it is travelling from the phase sensor electrode 29 to the time of flight sensor electrode 31. The time between these two pulses can be used to measure the time of flight. In the design of FIG. 16, a charged ink drop is coupled to the sensor electrode 47, and provides a signal accordingly, for as long as it is travelling along the length of the sensor electrode 47. As an ink drop comes level with the first end of the sensor electrode 47, coupling between the charged ink drop and the sensor electrode 47 begins and a signal pulse in a first direction is induced. When the drop reaches the other end of the sensor electrode the coupling between the sensor electrode 47 and the ink drop ceases and a signal pulse in the opposite direction is induced. The time of flight is calculated from the time between these two pulses in opposite directions. In practice, it appears that the time between the pulses is not exactly equal to the time a charged ink drop takes to travel the length of the sensor electrode 47, and the relationship between actual time of flight and the measured time is preferably determined experimentally in advance.

However, the first pulse signal, induced when coupling between a charged ink drop and the sensor electrode 47 begins, does not simply decay to zero but tends to be followed by an undershoot trough. In some designs, the undershoot trough can last for sufficiently long before the signal level returns to zero that it becomes combined with the opposite direction pulse created when the ink drop ceases to be coupled with the sensor electrode 47, so that the second pulse becomes hard to detect. For this reason, the design of FIG. 16 is less preferred than the designs of FIGS. 4, 9 and 14. At present, the design of FIGS. 9, 12 and 13 is most preferred.

If it is not desired to measure time of flight, or an alternative measurement method is used, the time of flight sensor electrode 31 can be omitted. In this case, the design of FIG. 16 is suitable for use since only a phase sensor electrode is required, and the design of FIG. 16 is effective to detect whether an ink drop is charged or not. If the time of flight sensor electrode 31 is omitted and only the phase sensor electrode 29 is provided, the phase sensor electrode 29 can be provided at any point along the length of the electrode assembly 17. However, it is still preferred to provide it close to the end of the electrode assembly 17 toward the charge electrode 3, as in FIGS. 4, 9 and 14, so as to reduce the time taken for drops to pass from the charge electrode 3 to the phase sensor electrode 29 during the phasing operation and hence reduce the total time taken for the operation.

Figure 17:
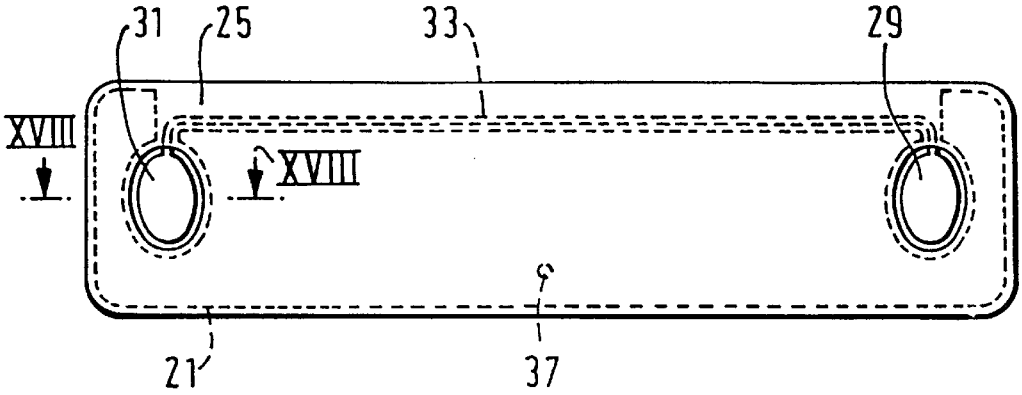
FIG. 17 shows a still further design of the face of the electrode assembly towards the ink jet.
Figure 18:
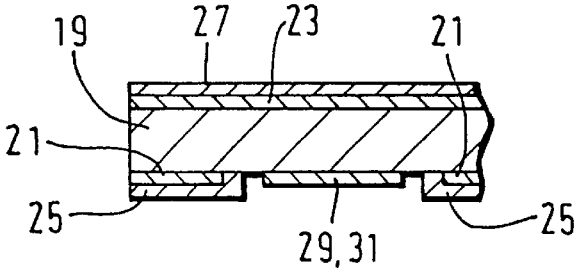
FIG. 18 is a partial section through the electrode assembly of FIG. 17 in the region of a sensor electrode.

FIG. 17 shows the face of the electrode assembly 17 according to the design of FIG. 9, but manufactured in a slightly different manner, and FIG. 18 is a section through the electrode assembly in the region of one of the sensor electrodes 29, 31. Although the design of FIG. 9 is shown, this manufacturing technique can be used for any other design for the face of the assembly.

In FIGS. 17 and 18 the conductive layer 21 does not extend behind the sensor electrodes 29, 31 and the conductor line 33. Instead, the conductive layer 21 is patterned as shown in FIG. 17 so as to approach the sensor electrodes 29, 31 and the conductor lines 33 but to stop short of them with a slight gap. This allows the sensor electrodes 29, 31 and the conductor lines 33 to be designed on the same artwork layer, and printed in the same screen printing operation, as the conductive layer 21, simplifying the manufacturing process. The sensor electrodes 29, 31 are insulated from the conductive layer 21 since they do not touch, and the ceramic plate 19 is an electrical insulator. In order to prevent splashes of ink from shorting the sensor electrodes 29, 31 to the conductive layer 21, a layer of insulator 25 is provided over the conductive layer 21. The layer of insulator 25 does not extend over the sensor electrodes 29, 31, but instead it stops in the gap between the sensor electrodes 29, 31 and the conductive layer 21. However, the layer of insulator 25 does extend over the conductor line 33.

In this design, the layer of insulator 25 does not provide the permanent insulation between the sensor electrodes 29, 31 and the conductive layer 21, but acts only to insulate the conductive layer 21 from splashes of ink which are also contacting one of the sensor electrodes 29, 31. Consequently, the quality of insulation provided by the insulator 25 is less important in this construction, and therefore the number of layers can optionally be reduced. FIG. 18 shows only a single layer of insulator 25. Additionally, the gap in the layer of insulator 25 over each sensor electrode 29, 31 is provided so that splashes of ink will make electrical contact with the sensor electrodes 29, 31, and it is not critical for this purpose that the entire area of each sensor electrode 29, 31 is exposed. Accordingly, it is possible for the layer of insulator 25 to overlap the sensor electrodes 29, 31 slightly, which makes the alignment between successive screen printing layers easier.

Figure 19:
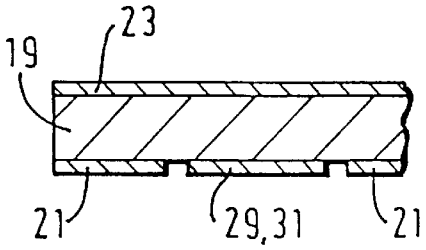
FIG. 19 is an alternative section of FIG. 18.
Figure 20:
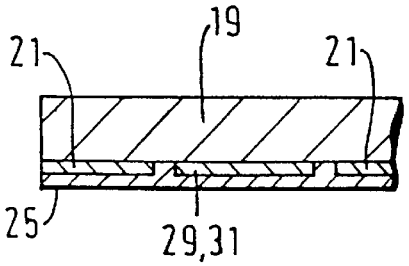
FIG. 20 is an alternative section to FIG. 18.

FIGS. 19 and 20 are sections corresponding to FIG. 18, of modifications of this construction. In FIG. 19 there is no layer of insulator 25 at all. In FIG. 20 the layer of insulator 25 extends across the sensor electrodes 29, 31 as well as the conductive layer 21. However, these arrangements are less preferred. In the arrangement of FIG. 19, a splash of ink which contacts both a sensor electrode 29, 31 and the conductive layer 21 will disable the sensor electrode by shorting it to the conductive layer 21 until the ink dries. In the arrangement of FIG. 20 a splash of ink over a sensor electrode 29, 31 will tend to "blind" the sensor, because the ink is not electrically connected to the sensor, until the ink dries and ceases to be conductive.

In all of the above constructions, the conductive layer 23 on the side of the electrode assembly away from the ink jet is optional, as is the layer of insulator 27 which covers it. Accordingly, by way of illustration FIG. 18 shows both the conductive layer 23 and the insulator 27. FIG. 19 shows the conductive layer 23 without the insulator 27, and in FIG. 20 neither the conductive layer 23 nor the insulator 27 is present. However, the conductive layer 23 is always preferred, as it assists in shielding the sensor electrodes 29, 31 from noise originating from outside the region enclosed by the deflection electrodes. Where the conductive layer 23 is provided, the insulator 27 is also preferred, to provide a protective layer. In the construction of FIG. 17, in which the conductive layer 21 on the side of the assembly facing the ink jet does not extend behind the sensor electrodes 29, 31, the conductive layer 23 on the other side of the assembly is particularly preferred, as otherwise the sensor electrodes 29, 31 would be substantially unshielded.

Figure 21:
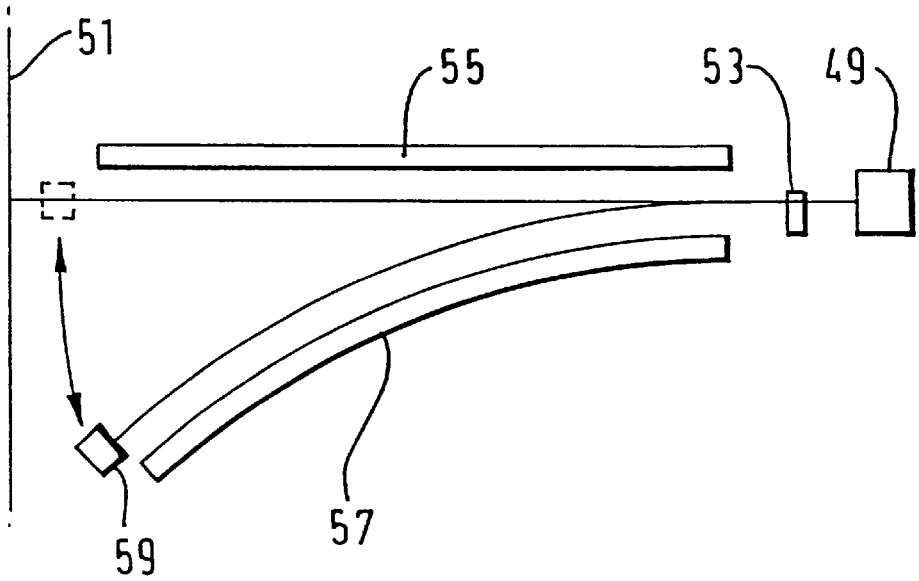
FIG. 21 shows schematically the main elements of a multi-jet ink jet printer seen in the direction in which the jets are spaced from each other.

FIG. 21 is a schematic view of a multiple jet graphics type deflection ink jet printer embodying the present invention, looking in a direction parallel to the direction of the spacing of the ink jets. FIG. 22 is a schematic view of the ink jet nozzles, charge electrodes, gutter and one deflection plate of the printer of FIG. 21, looking in a direction at 90° to the direction of view of FIG. 21. In the printer of FIGS. 21 and 22 a row of ink jet nozzles 49 provides an array of parallel ink jets, directed towards a surface 51 to be printed on to. A row of charge electrodes 53 is provided immediately downstream of the nozzles 49, so that each ink jet separates into drops while under the influence of a respective charge electrode 53. The drops of ink from the respective jets then pass through a deflection field generated by a pair of deflection electrodes 55, 57. As can be seen in FIG. 22, the printer does not have separate deflection electrodes for each ink jet but instead each deflection electrode extends continuously past the array of ink jets so as to be common to all of the ink jets. During printing, uncharged ink drops pass through the deflection field without being deflected, and strike the surface 51 to print a dot thereon. Drops which are required not to strike the surface 51 are charged and deflected into a gutter 59 which is positioned offset from the path of undeflected drops. As shown in FIG. 22, a single common gutter is provided for all of the ink jets, although multiple gutters are possible.

It is preferable to start the ink jets without any signal on the charge electrodes 53, and only apply the charging signals once the jets are running stably. In order to catch the initial uncharged drops at the time of starting the jets, the gutter 59 is motorised and moveable to an in-line position shown in broken lines in FIG. 21, in which it is in the path of undeflected drops. When the jets are running stably, a charging signal (e.g. 100 V) is applied to the charge electrodes 53 of all the jets, to deflect the jets to the normal, offset position of the gutter 59, shown in unbroken lines in FIG. 21, and the gutter is moved to this position. The gutter 59 may be sufficiently wide that it can catch the deflected drops even when it is in the in-line position. In this case, the jets can be deflected, and then the gutter can be withdrawn to the offset position so that it no longer catches undeflected drops. Alternatively, the gutter 59 may be moved simultaneously with the application of the deflection voltage to the charge electrodes 53, and the leading edge of the deflection voltage is arranged to rise at a rate such that the rate of increase of deflection matches the speed of movement of the gutter. As a further alternative, there may be two gutters. One gutter is arranged permanently in the position shown in unbroken lines in FIG. 21. The other gutter is movable between the position shown in broken lines in FIG. 21 and a retracted position in which it is out of the path of the undeflected drops, e.g. above (in FIG. 21) the line of the deflection electrode 55.

Phasing is carried out as described above, using low levels of voltage on the charge electrodes 53 so that the charged drops during phasing are only deflected slightly, and both the charged drops and uncharged drops during the phasing operation are caught by the gutter 59 when it is in the position shown in broken lines in FIG. 21.

The deflection electrode 55, which extends parallel to the undeflected drops, is provided by an electrode assembly having a ceramic plate, a conductive layer to provide the deflection electrode, and phase sensor electrodes 61, and can be constructed in the same manner as discussed with reference to FIGS. 3 to 20. However, the deflection electrode 55 is much wider than the electrodes of FIGS. 3 to 20 since the deflection electrode 55 extends past an array of ink jets rather than just one ink jet. A separate phase sensor electrode 61 is provided, in the same manner as the phase sensor electrode 29 of FIGS. 4 to 15 and 17, for each ink jet in the array. Accordingly, phasing can be carried out independently for each ink jet, using its respective phase sensor electrode 61. The signals from the respective phase sensor electrodes 61 are provided to the control circuit by respective coaxial cables, connected to respective sensor electrode connection pads on the back of the deflection electrode 55, and each sensor electrode connection pad is connected through a hole to the respective phase sensor electrode 61 as described with reference to FIGS. 3 to 20.

Figure 23:
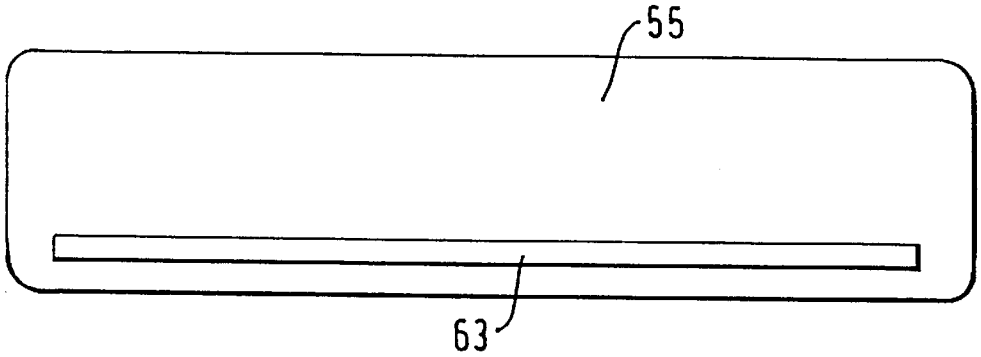

The electrode design of FIG. 22, having a separate phase sensor electrode 61 for each ink jet, requires that a separate signal cable is connected to each of the phase sensor electrodes 61, and the control electronics must be provided with appropriate signal reception circuitry, such as amplifiers and buffers, for each of the signal lines. Such an arrangement can be difficult and expensive to manufacture. In order to reduce the amount of wiring and the amount of signal processing circuitry required, an alternative electrode design can be used as shown in FIG. 23. In the electrode design of FIG. 23, the array of individual phase sensor electrodes 61 is replaced by a single continuous strip-shaped phase sensor electrode 63. This phase sensor electrode 63 will provide a signal in response to a charge on a drop from any of the ink jets provided by the array of nozzles 49. In order to perform a phasing operation with a particular one of the nozzles 49, the special charge electrode signal for phasing is applied only to the charge electrode 53 for the ink jet being phased, and all the other charge electrodes are kept grounded so that no charge is captured on the drops of any other jets. This ensures that the signals from the phase sensor electrode 63 are created only by the ink jet being phased. Consequently, the phasing operation can only be carried out on one ink jet at a time using the electrode design of FIG. 23, so that although the wiring and circuitry is simpler with this design the phasing operation takes longer.

Figure 24:
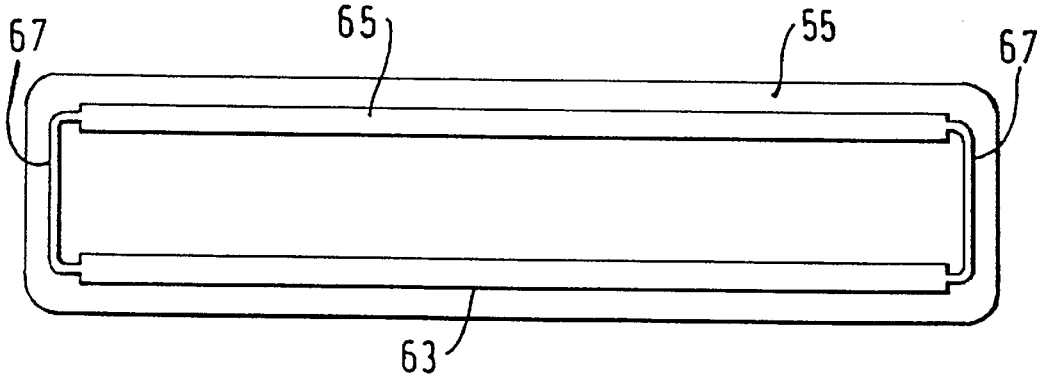

The electrode designs of FIGS. 22 and 23 do not include any sensor electrode for measuring time of flight. FIG. 24 shows an electrode design similar to FIG. 23, but in addition to the strip shaped phase sensor electrode 63 provided close to the upstream edge of the defection electrode 55 (the edge towards the nozzles 49), a strip shaped time of flight sensor electrode 65 is provided close to the downstream edge of the deflection electrode 55 (the edge towards the gutter 59). This enables the velocity of an ink jet to be measured by detecting the time taken for charged drops to pass from the phase sensor electrode 63 to the time of flight sensor electrode 65, as discussed above. The phase sensor electrode 63 and the time of flight sensor electrode 65 can be connected together by conductor lines 67 on the face of the deflection electrode 55 facing the ink jets, in a similar manner to the design of FIG. 4. As shown in FIG. 24, the conductor lines 67 extend away from each end of the sensor electrodes 63,65, so as to extend outside the area covered by the array of ink jets. As an alternative, one or more conductor lines 67 can be provided on the other face of the deflection electrode 55, away from the ink jets, in a similar manner to the design of FIGS. 14 and 15. As another alternative, separate sensor electrode connection pads can be provided for the phase sensor electrode 63 and the time of flight sensor electrode 65, and separate coaxial cables can be soldered to the respective pads, and the cables can be joined at any convenient place to provide a common signal line.

Although it is not illustrated, it is also possible to provide individual time of flight sensor electrodes for each ink jet, in a similar manner to the phase sensor electrodes 61 of FIG. 22. In this case, it is not possible to connect each individual time of flight sensor electrode to the respective phase sensor electrode 61 by a conductor line on the face of the deflection electrode 55 facing the ink jets, without the conductor lines being so close to the ink jets that they receive signals from charged drops. Therefore alternative arrangements should be used such as conductor lines on the other face of the deflection electrode 55 or separate coaxial cables.

Figure 25:
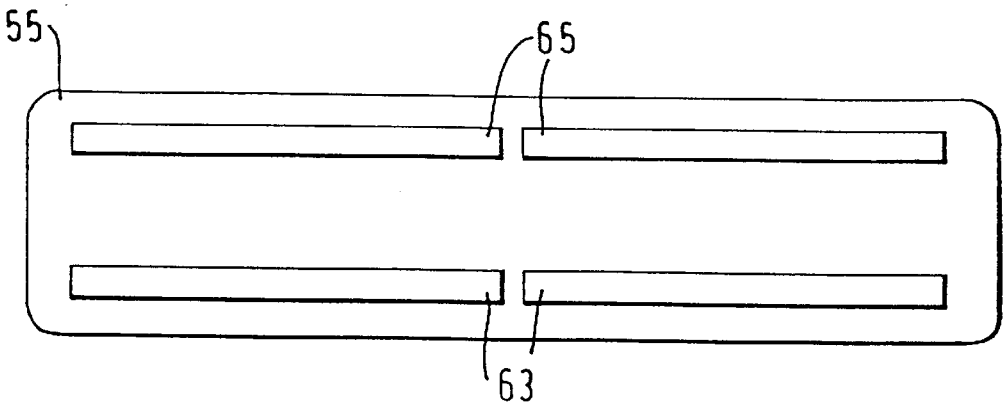

The degree of capacitive coupling between a charged ink drop and a strip shaped sensor electrode as shown in FIGS. 23 and 24 is only slightly greater than the degree of capacitive coupling between a charged ink drop and the corresponding individual phase sensor electrode 61 in the design of FIG. 22, so that the signal strength from the strip shaped sensor electrode is only slightly greater. However, a strip shaped sensor electrode has a much greater area than one of the individual phase sensor electrodes 61 of FIG. 22, and therefore it picks up a much greater amount of noise. As a consequence, the designs of FIGS. 23 and 24 provide a poorer signal-to-noise ratio than the design of FIG. 22, as well as requiring much more time to carry out a phasing operation for all of the ink jets. An alternative design is shown in FIG. 25, in which the strip shaped phase sensor electrode 63 and the strip shaped time of flight sensor electrode 65 are each divided into two half-length strips, each strip extending next to half of the ink jets. The design of FIG. 25 approximately doubles the signal-to-noise ratio from the sensor electrodes 63, 65. Additionally, with the design of FIG. 25 the phasing operation could be carried out simultaneously for two of the ink jets, one using each half-length strip, thereby halving the time required for carrying out a phasing operation on all of the jets.

The use of split sensor electrode strips as illustrated in FIG. 25 can be used to divide each of the sensor electrodes 63, 65 into three or more parts, if. desired, instead of dividing them into two parts as shown. As each strip is divided into more parts, more wiring and more sensor electronics are required but the signal-to-noise ratio improves and the time taken to conduct a phasing operation for all of the ink jets reduces. Each sensor electrode strip can be divided into any desired number of parts, from the continuous strip of FIGS. 23 and 24 as one extreme to a separate sensor electrode for each jet according to FIG. 22 as the other extreme.

Figure 26:
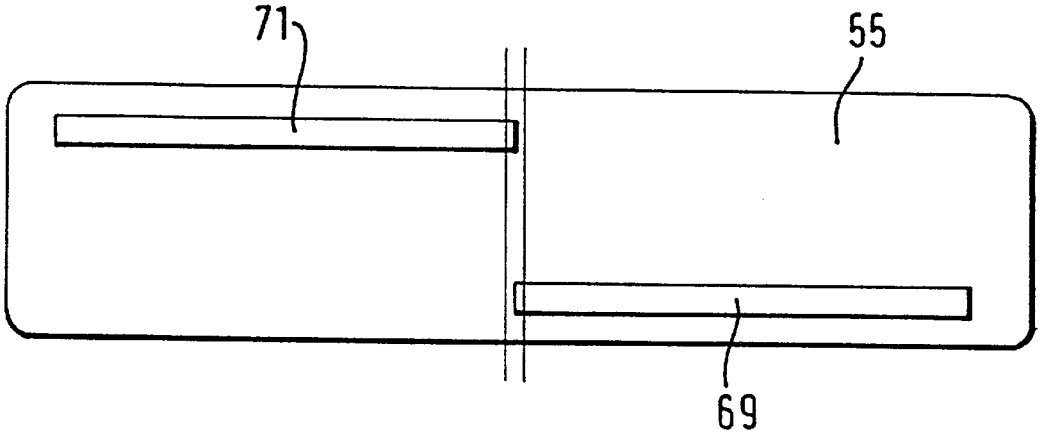

If it is assumed that all of the ink jets have substantially the same time of flight, it is possible to perform a phasing operation and obtain time of flight information using a design for the deflection electrode 55 with half-length sensor electrode strips, but with only half the total sensor electrode area of the design of FIG. 25, by omitting two diagonally opposed half length strips as illustrated in FIG. 26. In FIG. 26, a first half length strip 69 is provided spanning half of the ink jets and extending close to the upstream edge of the deflection electrode 55. A second half length strip sensor electrode 71 is provided spanning the other half of the ink jets, extending near the downstream edge of the deflection electrode 55. FIG. 26 also shows the lines of two adjacent ink jets, one passing over the first half length sensor electrode 69 and the other passing over the second half length sensor electrode 71, to illustrate that all of the ink jets pass one of the half length sensor electrodes 69, 71, but none of the ink jets pass both half length sensor electrodes 69, 71.

With the design of FIG. 26, phasing is carried out in the normal way using both of the half length sensor electrodes 69, 71. The phasing operation may be a little slower using the half length sensor electrode 71 by the downstream edge of the deflection electrode 55, as each ink drop will take longer to pass from the respective charge electrode 53 to this sensor electrode compared with the time taken to reach the sensor electrode 69 close the upstream edge of the deflection electrode 55. In order to measure time of flight with this design, a charging pulse is applied to all of the charge electrodes 53, or alternatively to charge electrodes 53 for one or some of the ink jets in each half of the array, so that a signal is induced in the half length sensor electrode 69 just after the charged drops pass the upstream edge of the deflection electrode 55, and a signal is induced in the half length sensor electrode 71 just before the charged drops reach the downstream side of the deflection electrode 55. The time of flight is measured as the time between the signals on these two sensor electrodes 69, 71.

Figure 27:
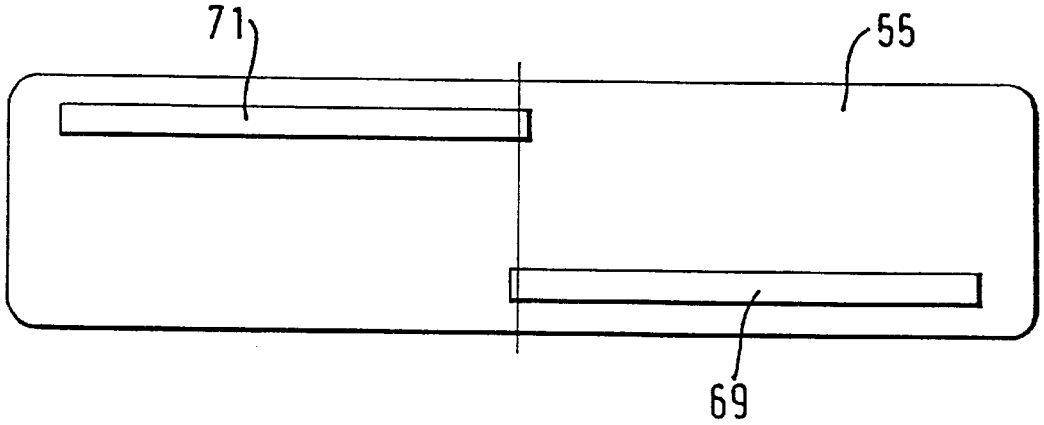

With the design of FIG. 26, the time of flight measurement assumes that the charged drops for all nozzles cross the lines of the sensor electrodes 69, 71 at the same time as each other, so that signals obtained from different ink jets can be compared. As an alternative, FIG. 27 illustrates a design in which each of the sensor electrodes 69, 71 of FIG. 26 has been slightly extended at the middle of the array of ink jets, so that one ink jet, illustrated in FIG. 27, passes both sensor electrodes 69, 71. In this case, the time of flight measurement is made by placing a charging pulse only on the charge electrode 53 for the particular ink jet which passes both sensor electrodes 69, 71.

Figure 28:
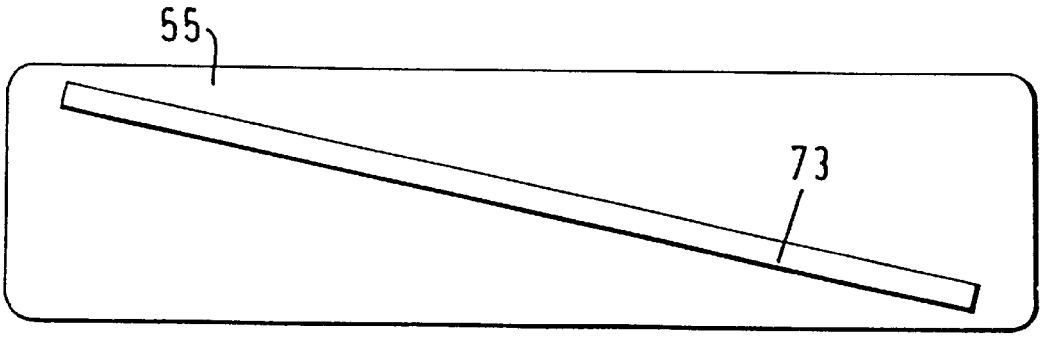

FIG. 28 shows yet another design for the deflection electrode 55. In this design, a single strip shaped sensor electrode 73 is provided extending diagonally across the deflection electrode 55. This sensor electrode 73 can be used as a phase sensor electrode for a phase operation on each ink jet in turn, in a similar manner to the use of the phase sensor electrode 63 in FIG. 23. However, unlike the design of FIG. 23, the design of FIG. 28 can be used to make a time of flight measurement using a similar approach to the approach used with the design of FIG. 26. If a charging pulse is applied to the charge electrode 53 of only two of the ink jets, preferably the ink jets at opposite ends of the array, the charged drops from one of the jets will cross the sensor electrode 73 before the charged drops of the other jet, owing to the diagonal position of the sensor electrode 73. The time between the signal pulses provided by the charged drops of these two ink jets provides the measure of the time of flight.

No sectional views have been provided for the electrode designs of FIGS. 22 to 26 since the constructions and sections of FIGS. 5, 7, 11, 13 and 18 to 20 can all be applied to these designs.

In multijet printers, the deflection electrodes 55, 57 tend to be positioned closer together, and a lower deflection voltage difference is used, compared with single jet printers. Therefore, provided that the phasing operation is carried out using a sensor electrode near to the upstream (with respect to the ink jet) edge of the deflection electrode, the sensor electrode can be positioned on either the upper (in FIG. 21) deflection electrode 55 or the lower (in FIG. 21) deflection electrode 57. If desired, the phasing operation can also be conducted by placing a continuous voltage (e.g. 100 V) on all the charge electrodes 53 to deflect all the jets into the gutter 59 at its normal offset operating position, and a small additional signal is superimposed on this continuous voltage to provide the change in charge detected during a phasing operation. If it is also desired to carry out the time of flight measurement with the gutter 59 in its normal offset operating position, it is desirable to provide a sensor electrode on the lower (in FIG. 21) deflection electrode 57. It is advantageous to allow the phasing operation to be carried out, and optionally the time of flight to be monitored, with the gutter 59 in its position for printing, because these operations can in this case be carried out without interrupting printing (because the gutter 59 does not have to be moved), and therefore can be carried out repeatedly during normal operation of the printer.

In order to perform phasing or time of flight measurement using the gutter 59 in its position for printing (shown in unbroken lines in FIG. 21) it is necessary that the velocities of the jets are sufficiently close to the correct value that the continuous voltage on the charge electrodes 53, both with and without the small additional signal, is effective to deflect the drops reliably into the gutter 59 when in this position. If it is not possible to guarantee this jet velocity when initially starting the jets, a sensor electrode arrangement may be formed on the upper (in FIG. 21) deflection electrode 55 adjacent the undeflected drops, for measuring the time of flight, in addition to the sensor electrode or electrodes on the other deflection electrode 57. After the jet is started, a low level pulse lasting several drop periods (e.g. 10 V for 125 $\mu$s) is applied to the charge electrodes 53 while the gutter 59 is still in its position shown in broken lines in FIG. 21. The sensor electrode arrangement on the upper (in FIG. 21) deflection electrode 55 is then used to measure time of flight, and the jet velocities are adjusted (e.g. by adding solvent to the ink or varying the ink pressure) until they are correct. Then the continuous large (e.g. 100 V) voltage is applied to the charge electrodes 53 to deflect the jets into the offset position of the gutter 59 shown in unbroken lines in FIG. 21 and the gutter is moved to this position. The sensor arrangement on the lower (in FIG. 21) deflection electrode 57 is used from then on.

In the illustrated embodiments the deflection electrode assembly 17 or 55 includes the ceramic plate 19 as a supporting substrate, since this is the normal substrate material used in hybrid circuit board manufacturing due to its electrical insulating ability and its ability to withstand the heat of the baking steps. However, the use of such a substrate is not essential, and any convenient method can be used to form the conductive deflection electrode, the conductive sensor electrode or electrodes, and the insulation between them. If a metal plate is used as the supporting substrate, it can also form the deflection electrode so that a separate conductive layer for the deflection electrode is unnecessary.

The thickness of the insulation between the sensor electrode or electrodes and the deflection electrode is not critical, although preferably this thickness is less than 0.5 mm to maintain capacitive coupling between the electrodes and effective shielding by the deflection electrode. The thickness of the sensor electrode or electrodes is also not critical, but it is preferred that either this thickness does not exceed 0.5 mm or else the sensor electrode (or electrodes) is recessed into the deflection electrode, so as to limit the extent by which the sensor electrode (or electrodes) protrudes from the surface of the deflection electrode.

It is possible to use conventional copper-clad glass-fibre substrate circuit board manufacturing techniques to make the electrode assembly. However, in such techniques it is normal to make a conductive layer by starting with a complete copper coating and etching away unwanted copper. This process tends to leave sharp edges on the remaining copper. Such sharp edges should either be insulated or smoothed to avoid sparking in the electrostatic deflection field.

It is also possible to manufacture the electrode assembly by starting with a stainless steel deflection electrode plate, as used in FIGS. 1 and 2, and coating it with an insulating layer e.g. by electrophoresis to deposit a layer of acrylic, epoxy resin or vitreous enamel, or by painting or dip-coating, or in any other convenient way, followed by curing in an oven if necessary. The sensor electrodes can then be provided by sticking appropriately shaped pieces of adhesive backed copper foil to the surface of the insulated deflector plate. The piece of copper foil for each sensor electrode can be extended around the edge of the electrode to the other face, to make a connection pad for the signal line.

Embodiments of the present invention can be made by very simple modifications of a conventional metal deflection electrode plate as used in FIGS. 1 and 2, although such embodiments will tend to work less well than those previously illustrated. For example, as shown in FIG. 29 a prior art metal deflection electrode plate 9 can be modified by winding wire 85 around it close to one end to form a sensor electrode, or close to both ends if both a phase sensor electrode and a time of flight sensor electrode are required. In order to insulate the wire 85 from the deflection electrode 9, a piece of insulating material may be placed around the deflection electrode 9 before the wire 85 is wound. Alternatively, insulated wire can be used. In this case, it is preferable to use wire having very thin lacquer-type insulation, as is commonly used for winding transformers, rather than wire with bulkier PVC insulation.

FIGS. 30 and 31 show another possible construction. In this case, the phase sensor electrode 29 and the time of flight sensor electrode 31 are formed using sensor electrode pins surrounded by and insulated from earthed shielding cylinders, similar to those used for forming the known sensor electrodes of FIGS. 1 and 2. The ends of the sensor electrodes 29, 31 are substantially flush with the face of the deflection electrode 9 facing the ink jet. The construction of FIGS. 30 and 31 can be made by drilling holes of the appropriate diameter in the deflection electrode 9 at the positions where the sensor electrodes 29, 31 are required, placing the deflection electrode 9 face down on a surface and inserting the shielded sensor electrode assemblies from the rear so that front surfaces will be aligned. A section through the resulting construction, in the region of one of the sensor electrodes 29, 31 is shown in FIG. 31. As shown in FIG. 31, the shielding cylinder 87 can be soldered at 89 to the rear surface of the deflection electrode 9 to secure the sensor electrode assembly to the deflection electrode. The sensor electrode itself is provided by the central pin 91, which is insulated from the shielding cylinder 87 and the deflection electrode 9 by a layer of insulator 93.

As with the construction of FIGS. 1 and 2, this arrangement has the disadvantage that a splash of ink contacting one of the sensor electrodes 29, 31 will short the pin 91 to the shielding cylinder 87 (and also to the deflection electrode 9). This can be prevented by applying a thin layer of insulator over the front surface of the deflection electrode 9, but this will also cover the end of the pin 91 so that a splash of ink over a sensor electrode will now tend to "blind" it.

If the construction of FIGS. 30 and 31 is manufactured using the same diameter for the pin 91 as in the sensor electrodes 5, 15 of FIGS. 1 and 2, the ink drops will have to pass very close to the sensor electrodes in order to obtain a strong enough signal, so that precise jet alignment will be required and the disadvantage that a layer of caked dried ink may interfere with the ink drops will also arise. However, the advantage of reducing the length of the ink path is provided since the sensor electrodes 29, 31 are within the length of the deflection electrode 9.

Additionally, the arrangement of a central pin surrounded by and insulated from a shielding cylinder is available commercially at a range of diameters for the pin 91, and therefore a larger pin diameter can be used in the construction of FIGS. 30 and 31 to obtain a larger sensor electrode area. This allows the sensor electrodes 29, 31 and the deflection electrode 9 to be spaced further from the ink jet, with the resulting advantages as discussed above. Large diameter pins are not used in the known construction of FIGS. 1 and 2, because they increase the total diameter of the sensor electrodes and consequently increase the length of the ink path.

Although there is a wide variety of ways of manufacturing the electrode assembly, the use of hybrid circuit board manufacturing techniques are presently preferred because they provide both a convenient way of connecting the sensor electrodes on one face of the assembly to a connection pad on the other face, and the conductive layer forming the sensor electrodes can be made resistant to methyl ethyl ketone. Although susceptible materials used in other techniques can be protected from methyl ethyl ketone by a layer of a suitable encapsulating material, this results in an insulating layer covering the sensor electrodes, with the undesirable consequence that splashes of conductive ink tend to prevent the sensor electrodes from responding to charged ink drops.

Various alternative designs and combinations of features have been provided by way of illustration, but many other ways of combining features and providing embodiments of the invention will be apparent to those skilled in the art, and the present invention is not limited to the embodiments shown and features may be combined in permutations other than those of the illustrated embodiments.

What is claimed is:

1. An electrode assembly for an electrostatic deflection type ink jet printer, comprising: a deflection electrode; a sensor electrode positioned within the area of the deflection electrode and insulated from the deflection electrode; and an insulating supporting substrate, the deflection electrode being provided as a layer of conductive material on the supporting substrate.

2. An electrode assembly according to claim 1 which comprises an insulating layer on the deflection electrode, the sensor electrode being provided on the insulating layer, and in which the insulating layer covers substantially the whole of the face of the deflection electrode on which the sensor electrode is formed.

3. An electrode assembly according to claim 1, comprising a connection area for a conductor on the reverse side of the electrode assembly from the sensor electrode, the sensor electrode being connected, via a hole through the electrode assembly, to said connection area.

4. An electrode assembly according to claim 3 in which the hole is provided at the location of the sensor electrode.

5. An electrode assembly according to claim 1 in which a further sensor electrode is provided within the area of the deflection electrode and insulated from the deflection electrode.

6. An electrode assembly according to claim 5 in which said sensor electrodes are electrically connected together.

7. An electrode assembly according to claim 1 which is suitable for use with a multi-jet ink jet printer, and in which the sensor electrode extends past the paths of a plurality of jets in use.

8. An electrode assembly according to claim 1 which is suitable for use with a multi-jet ink jet printer, in which the deflection electrode is substantially rectangular, and the sensor electrode extends continuously from substantially adjacent a first edge of the deflection electrode to substantially adjacent a second edge, opposite the first edge, of the deflection electrode.

9. An electrode assembly according to claim 8 in which the sensor electrode or electrodes extends substantially diagonally across the deflection electrode.

10. An electrode assembly according to claim 8 in which the sensor electrode or electrodes extend substantially parallel to a third edge of deflection electrode, which extends between the first edge and the second edge.

11. An electrode assembly according to claim 1 which is suitable for use with a multi-jet ink jet printer, in which the deflection electrode is substantially rectangular, and a plurality of sensor electrodes each extends a respective part of the way from substantially adjacent a first edge of the deflection electrode to substantially adjacent a second edge, opposite the first edge, of the deflection electrode.

12. An electrode assembly according to claim 11 in which the sensor electrode or electrodes extends substantially diagonally across the deflection electrode.

13. An electrode assembly according to claim 11 in which the sensor electrode or electrodes extend substantially parallel to a third edge of deflection electrode, which extends between the first edge and the second edge.

14. An electrode assembly according to claim 13 in which the plurality of sensor electrodes extend in line with one another.

15. An electrode assembly according to claim 14 in which the plurality of sensor electrodes extend substantially adjacent the third edge of the deflection electrode.

16. An electrode assembly according to claim 13 in which the plurality of sensor electrodes comprises a first sensor electrode and a second sensor electrode which are offset from each other in the direction from the first edge of the deflection electrode to the second edge of the deflection electrode and are also offset from each other in the direction from the third edge of the deflection electrode to a fourth edge, opposite the third edge, of the deflection electrode.

17. An electrode assembly according to claim 16 additionally comprising a third sensor electrode in line (in the direction from the first edge to the second edge of the deflection electrode) with the first sensor electrode and a fourth sensor electrode in line (in the direction from the first edge to the second edge of the deflection electrode) with the second sensor electrode.

18. An electrode assembly according to claim 17 in which the first sensor electrode is electrically connected to the fourth sensor electrode and the second sensor electrode is electrically connected to the third sensor electrode.

19. An ink jet printer comprising: an electrode assembly according to claim 1; a further deflection electrode; at least one charging electrode; at least one ink jet nozzle for emitting an ink jet past the charging electrode, between the deflection electrodes, and past the sensor electrode; and a control circuit for applying a deflection potential difference between the deflection electrodes, applying a charging voltage to the charging electrode, and receiving a signal from the sensor electrode, the control circuit being constructed or programmed to perform a phasing operation in which the sensor electrode is used to detect the presence of charged ink drops.

20. An ink jet printer according to claim 19 in which the deflection electrode of the electrode assembly is connected to a ground conductor of the control circuit.

21. An ink jet printer according to claim 19 in which the deflection electrode of the electrode assembly is held, during application of the deflection potential difference, at substantially the same potential as the rest potential of the sensor electrode.

22. An ink jet printer according to claim 21 in which the deflection electrode of the electrode assembly is connected to a ground conductor of the control circuit.

23. An ink jet printer according to claim 19 in which the electrode assembly comprises a further sensor electrode provided within the area of the deflection electrode and insulated from the deflection electrode, and the control circuit is constructed or programmed to measure the time of flight of charged ink drops from the position of one of the sensor electrodes to the position of the other of the sensor electrodes.

24. An ink jet printer according to claim 19 which has a plurality of ink jet nozzles for emitting an array of ink jets.

25. A method of making an electrode assembly for an electrostatic deflection type ink jet printer comprising:

forming an insulating supporting substrate;

forming a deflection electrode on the insulating supporting substrate;

forming an insulating layer on the deflection electrode; and forming a sensor electrode on the insulating layer, within the area of the deflection electrode, and insulated from the deflection electrode.

26. An ink jet printer having a deflection electrode, a sensor electrode, and an insulating supporting substrate for said electrodes, in which the deflection electrode is formed on the face of the substrate toward the ink jet path, and the sensor electrode is formed on the face of the deflection electrode toward the ink jet path and is separated therefrom by an insulating layer formed on the face of the deflection electrode.

27. A printhead for an electrostatic deflection type ink jet printer, comprising:

first and second deflection electrodes positioned facing each other, for generating an electric field to deflect electrically charged ink drops which pass between them; and a sensor electrode positioned within the area of the first deflection electrode, facing the second deflection electrode, and within the length of the second deflection electrode, the sensor electrode being insulated from the first deflection electrode.

28. A printhead according to claim 27 which comprises an insulating layer on the first deflection electrode, the sensor electrode being provided on the insulating layer.

29. A printhead according to claim 27 further comprising an insulating supporting substrate, the first deflection electrode being provided as a layer of conductive material on the supporting substrate.

30. A printhead according to claim 27 in which a further sensor electrode is provided within the area of the first deflection electrode and insulated from the first deflection electrode.

* * * * *